United States Patent [19]

Goodwin et al.

[11] Patent Number: 4,506,879

[45] Date of Patent: Mar. 26, 1985

[54] SHEET REGISTERING MECHANISM

[75] Inventors: Eber L. Goodwin, Arlington Heights; James E. L. Zeigler, Cary, both of Ill.

[73] Assignee: AM International, Inc., Chicago, Ill.

[21] Appl. No.: 438,557

[22] Filed: Nov. 2, 1982

[51] Int. Cl.[3] ..... B65H 9/00

[52] U.S. Cl. ..... 271/238; 271/240; 271/253

[58] Field of Search ..... 271/236, 237, 238, 240, 271/253, 254, 255

[56] References Cited

U.S. PATENT DOCUMENTS

| | | | |
|---|---|---|---|
| 1,066,528 | 7/1913 | Randolph | 271/238 |
| 1,615,590 | 1/1927 | Low | 271/238 |
| 2,699,940 | 1/1955 | Huck | 271/254 X |
| 2,974,953 | 3/1961 | Kaschner | 271/240 |
| 3,022,998 | 2/1962 | Patalon | 271/240 |

*Primary Examiner*—Richard A. Schacher
*Attorney, Agent, or Firm*—Nicholas A. Camasto

[57] ABSTRACT

A mechanism for registering sheets in a printing or duplicating machine which includes a conveyor board for delivering the sheets seriatim to the registering mechanism. A stop guide is mounted on a fixed support of the machine at one side of the conveyor board. A jogger guide is mounted on a jogger device of the machine at the opposite side of the conveyor board. The jogger guide includes a spring loaded blade for acting against a side edge of the sheet to move the sheet laterally to engage an opposite side edge of the sheet against the stop guide. The spring pressure of the blade is adjustable to accommodate sheets of varying weight, and the blade is provided with floating movement to accommodate sheets which are skewed or out-of-square. A calibrated dial is employed for incrementally adjusting the location and spring pressure of the blade. The stop guide and jogger guide are easily converted for left hand or right hand jogging, or vice versa, without removing either guide from the machine.

16 Claims, 7 Drawing Figures

SHEET REGISTERING MECHANISM

BACKGROUND OF THE INVENTION

This invention relates to sheet registering devices and, particularly, to a mechanism for registering sheets in a printing machine or the like which includes a conveyor board for delivering the sheets seriatim to the registering mechanism.

The production of high quality copies on office-type printing machines, such as lithographic duplicating machines, depends to a large extent on the ability of the machine to deliver sheets to a printing couple of the machine in accurate registration. Generally, registration of the sheets is effected on the conveyor board immediately prior to feeding the sheets to the printing couple. Sheet guides, normally including a fixed stop guide at one side of the conveyor board and a pusher or jogger guide at the opposite side of the conveyor board, conventionally are disposed immediately prior to advancement of the sheet to the printing couple. The jogger guide acts against a side edge of a sheet to move the sheet laterally to engage an opposite side edge of the sheet against the stop guide.

In conventional machines, the side guides on the conveyor board are positioned to align the sheets fed from a sheet tray to an image on a printing plate or a master mounted on a master cylinder of the printing couple. A sheet is advanced from the feed tray to the conveyor board, arrested momentarily between the side guides with a lead end of the sheet in contact with stop fingers on an impression cylinder and then jogged by the jogger guide against the stop guide to register the sheet prior to forwarding the sheet to the printing couple.

A common form of registering mechanism of the prior art includes a rigid jogger guide for jogging the sheet against a stop guide which is provided with spring means such as leaf spring members which abut against a side edge of the sheet. The leaf spring members are provided to yield and thereby compensate for variations in the squareness of the sheets to effect proper registration.

In particular, most paper stock is not cut perfectly square and the sheets vary in squareness and width from ream-to-ream. Consequently, one of the problems of prior art sheet registering mechanisms is their inability to adequately compensate for sheets which are skewed in orientation or out-of-square in cut. This is particularly true in machines which print or duplicate various kinds of sheets at high speed.

In addition to the lack of squareness of the sheets, other variations affecting registration are caused by wearing of parts of the registering devices, such as bushings, cams and shafts associated with the register system and the inability of the registering springs, such as the aforesaid leaf spring members, to adjust accordingly.

Heretofore, there has been no adequate means for adjusting the biasing pressure of the spring means of the registering device to accommodate sheets of varying squareness and width.

Another problem of prior art registering mechanisms is their inability to be readily changed or repositioned to accommodate changes in sheet size, weight or the like. With known prior art mechanisms, such procedures are quite time consuming and require considerable manual dexterity on the part of the machine operator.

Still another problem with art devices of the character described is their inability to be readily changed to position the jogger guide at either side of the conveyor board without considerable time consuming manipulation. In particular, when various printing or duplicating jobs are required to print images on both the front and back of a sheet, it is desirable to reverse the position of the jogger and stop guides at either side of the conveyor board. These types of printing jobs commonly are termed "work and turn" jobs, and usually are encountered with duplicating forms requiring precise line orientation. In most prior art machines, the stop guide and the jogger guide must be completely removed from the conveyor board to have their positions reversed on opposite sides of the board to jog the sheets in opposite directions for printing jobs of the character described.

The present invention is directed to solving problems described above in known sheet registering mechanisms by providing a jogger side guide with a sensitive spring loaded blade for jogging a sheet against a stop side guide, and selectively settable calibrated dial means for adjusting the spring pressure of the blade means in minute increments to effect precise registration of the sheets at high speed on the conveyor board of a printing or duplicating machine. The dial means is interchangeable for varying the calibration, and the spring loaded blade means is provided with floating movement to accommodate sheets which are skewed in orientation or out-of-square in cut. The side guides also can be converted from a stop guide to a jogger guide without removing the guides from their respective positions on opposite sides of the conveyor board.

SUMMARY OF THE INVENTION

An object, therefore, of the present invention is to provide a new and improved mechanism for registering sheets in a printing or duplicating machine wherein the machine normally includes a conveyor board for delivering the sheets seriatim to the registering mechanism.

Another object of the invention is to provide a registering mechanism which has spring loaded blade means on one of the guides, the blade means having floating movement to accommodate skewed or out-of-square sheets.

A further object of the invention is to provide a registering mechanism of the character described wherein the spring pressure of the spring loaded blade means is adjustable to accommodate sheets of varying weight.

Still another object of the invention is to provide a sheet registering mechanism of the character described wherein the stop guide and jogger guide can be converted at opposite sides of the conveyor board without removing the guides from the board.

In the exemplary embodiment of the invention, the sheet registering mechanism includes stop guide means mounted on a fixed support of the machine at one side of the conveyor board. Pusher or jogger guide means is mounted on a jogger device of the machine at the opposite side of the conveyor board. The jogger guide means includes spring loaded blade means for acting against a side edge of a sheet to move the sheet laterally to engage an opposite side edge of the sheet against the stop guide means. Means is provided for adjusting the spring pressure of the blade means to accommodate sheets of varying weight.

The jogger guide means includes a support frame in the form of a mounting block, with means mounting the spring loaded blade means on the mounting block for floating movement relative thereto to accommodate sheets which are skewed in orientation or out-of-square in cut. More particularly, a pilot pin is disposed between the blade means and the mounting block, and a pair of compression springs are spaced on opposite sides of the pilot pin, in the direction of movement of the sheets, and disposed between the mounting block and the blade means. This provides a sensitive spring-floating action for the blade means.

In order to adjust the spring pressure of the blade means and to readily convert the jogger guide means to a stop guide means, a control shaft extends through the mounting block and is fixed on the inside of the shaft to the blade means. A manually rotatable dial is fixed to the opposite end of the control shaft on the outside of the mounting block. The control shaft is threaded into the block and, by rotating the dial, the spring pressure on the blade means can be adjusted. In addition, the blade means can be drawn rigidly against the mounting block to convert the jogger guide means to a fixed guide means. Thus, substantially identical side guide means can be provided on opposite sides of the conveyor board and converted between a stop guide and a jogger guide without removing the guide means from the conveyor board.

In order to effect the aforesaid conversion, the mounting block is engageable with both the fixed support and the jogger device of the machine. Locking means is provided on each mounting block of each guide means. The locking means is selectively lockable with either the fixed support or the jogger device to form either a stop guide means or a jogger guide means, respectively.

In order to provide calibrated adjustment of the spring pressure of the blade means, detent means is provided between the rotatable adjusting dial and the mounting block of the guide means. The dial itself has a plurality of angularly spaced detents to provide for calibrated adjustment. It is contemplated to provide a plurality of dials each of which is releasably mounted on the control shaft for interchanging the dials. The dials have differently spaced detents to vary the calibrated adjustment. This is important to accommodate various halftone dot spacing in lithographic printing, as well as decimal or metric units.

Another feature of the invention is the provision of a pair of guide members in the form of blades adjustably mounted in laterally spaced relation on the conveyor board in advance of the stop and jogger guide means. The guide members are positioned for pre-aligning a sheet prior to final registration of the sheet by the stop and jogger guide means. This is particularly important with high speed printing or duplicating machines.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
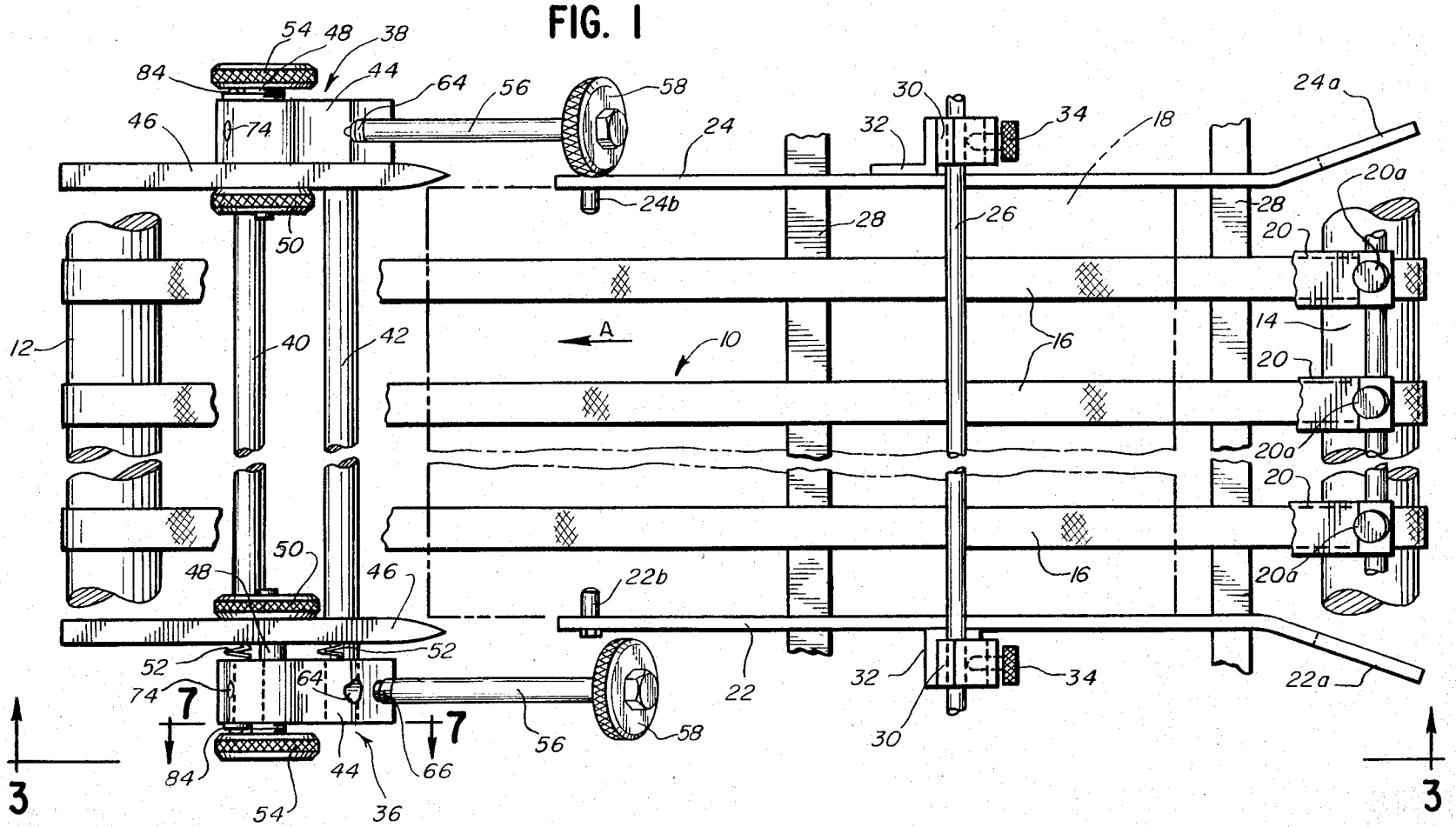
FIG. 1 is a fragmented plan view of the sheet registering mechanism of the present invention, adapted to jog sheets from the left-hand side of a conveyor board.
Figure 4:
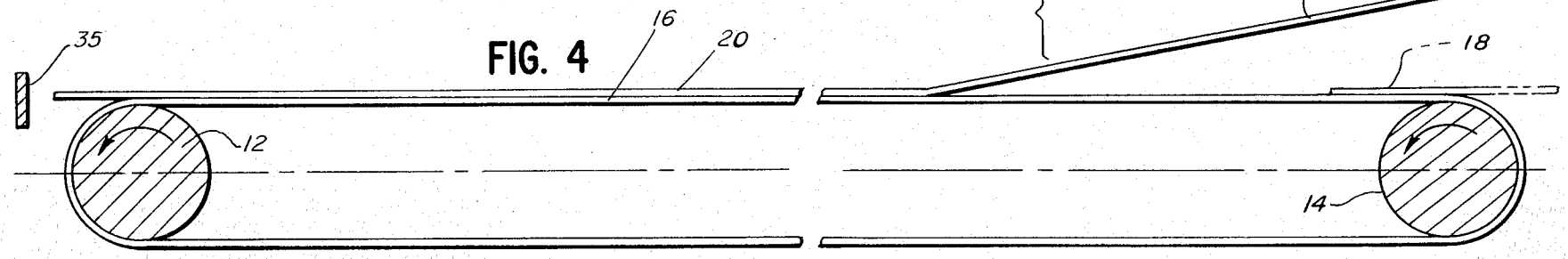
FIG. 4 is a sectional view through the printing machine, showing a side elevational view of a sheet retaining means for holding sheets against belts of the conveyor board during transport.

Referring to the drawings in greater detail, and first to FIG. 1, a conveyor board, generally designated 10, is shown to comprise a pair of conveyor rollers 12 and 14 drivingly supporting a plurality of endless belts 16 for transporting a sheet 18 in the direction of arrow A. Although not shown in the drawing, the sheet is fed from a feed tray to the conveyor board and then to a printing couple of a duplicating machine, such as an offset lithographic machine. During transport of the sheet by belts 16 on the conveyor board, the sheet is held against the belts by sheet retainer strips 20 (see FIG. 4) associated with and above each belt 16.

A pair of pre-alignment guide members or blades 22 and 24 are adjustably mounted on a rod 26 extending laterally across and above conveyor board 10. Guide members 22, 24 depend from rod 26 and rest upon a pair of tie-bars 28 beneath belts 16 of the conveyor board. Both guide members are identical except that guide member 22 is arranged for the left side of the conveyor board and guide member 24 is arranged for the right side of the conveyor board, with correspondingly outwardly flared portions **22*a* and 24*a*** for the entry of sheets between the guide members.

Guide members 22, 24 are provided with inwardly directed pins **22*b* and 24*b*, respectively, projecting laterally inwardly above belts 16. The pins are provided to bias sheet 18 downwardly against belts 16** in those instances where the sheet is travelling at a high speed and tends to lift from the conveyor board. Such lifting action of the sheet may be caused by skewed feeding of the sheet from the feed tray or when feeding heavy stock such as envelopes, cards or the like.

Each guide member 22, 24 also includes a bracket 30 fixed to the outside of the respective guide member by an angle plate 32. Bracket 30 forms a clamp to hold the respective guide member on rod 26 by means of a thumb screw 34. The guide members are movable along rod 26 by manipulating thumb screws 34 to position the guide members at selected positions to accommodate and pre-align sheets of various widths and sizes. In practice, the guide members are positioned sufficiently close to the side edges of sheet 18 to direct a sheet delivered from the sheet feed tray to within 0.031 inch (0.79 mm) of a final register position. This preliminary alignment of the sheet by the guide members alleviates sheet skewing on the conveyor board caused by static electricity in the sheets, improper sheet feeder pick-up in the sheet feed tray, curled stock and various temperature and humidity conditions.

Final registration of sheet 18 is effected by a first registration surface defined by stop finger means 35 (FIGS. 3 and 4), pusher or jogger guide means, generally designated 36, and a second registration surface defined by stop guide means, generally designated 38, with reference to FIG. 1. Stop finger means 35 extends on a line perpendicular to the path of travel of the sheet. At this point it should be understood that jogger guide 36 and stop guide 38 are designated as such in FIG. 1 because of their conditioning by an operator of the machine. Otherwise, the guides are identical and can be converted one to the other as described in greater detail hereinafter. In other words, jogger guide 36 is shown in FIG. 1 on the left-hand side of conveyor board 10, and stop guide 38 is shown on the right-hand side of the conveyor board.

Figure 2:
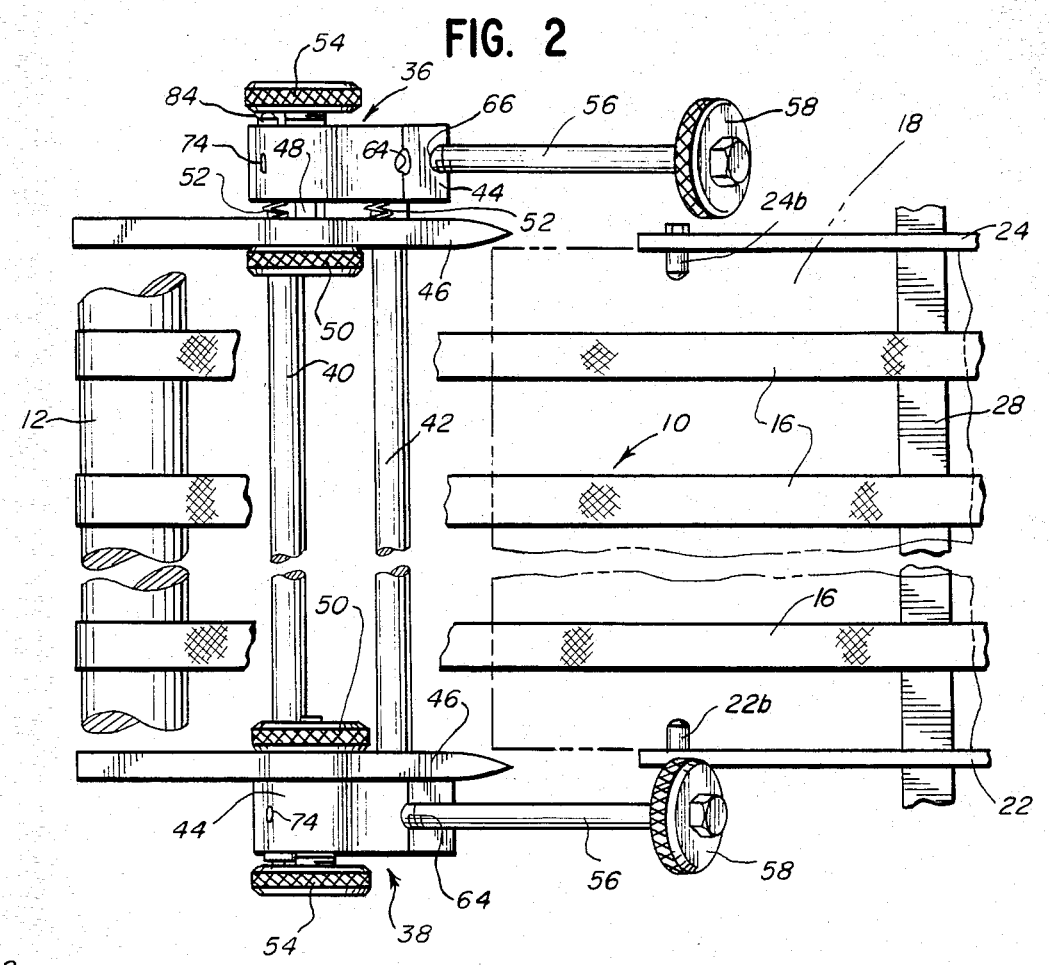
FIG. 2 is a fragmented plan view similar to FIG. 1, with the mechanism adapted to jog sheets from the right-hand side of the conveyor board.

FIG. 2 shows guides 36, 38 converted by an operator of the machine whereby jogger guide 36 now is conditioned on the right-hand side of conveyor board 10, and stop guide 38 is conditioned on the left-hand side of the conveyor board.

In general, and still referring to FIGS. 1 and 2, the printing or duplicating machine includes a fixed support in the form of a rod 40 extending transversely across and beneath conveyor board 10, and a jogger device in the form of a rod 42 similarly extending across and beneath the conveyor board. Each guide 36, 38 includes a support frame in the form of a mounting block 44 which is positionable on both fixed support 40 and jogger device 42. A spring loaded blade 46 is mounted on the inside of each mounting block by means of a control shaft 48 extending through the mounting block. A thumb screw 50 positions the spring loaded blade on the inside end of control shaft 48. A pair of compression springs 52 are disposed between mounting block 44 and blade 46 to spring load the blade. A thumb wheel 54 is secured to the outside end of control shaft 48 and provides a dial for adjusting the spring pressure of blade 46 to accommodate sheets of varying weight. Compression springs 52 provide for floating movement of blade 46 relative to mounting block 44 when the guide is conditioned as a jogger guide to accommodate sheets which are skewed in orientation or out-of-square in cut.

Locking means in the form of a long-stem bolt 56, having a knurled head 58, is provided for locking mounting block 44 to either fixed support 40 or jogger device 42. Depending on whether mounting block 44 is locked to the fixed support or the jogger device (rods 40 and 42, respectively), the guides can be converted between a jogger guide 36 and a stop guide 38 without removing the guides from their positions alongside the conveyor board.

Figure 3:
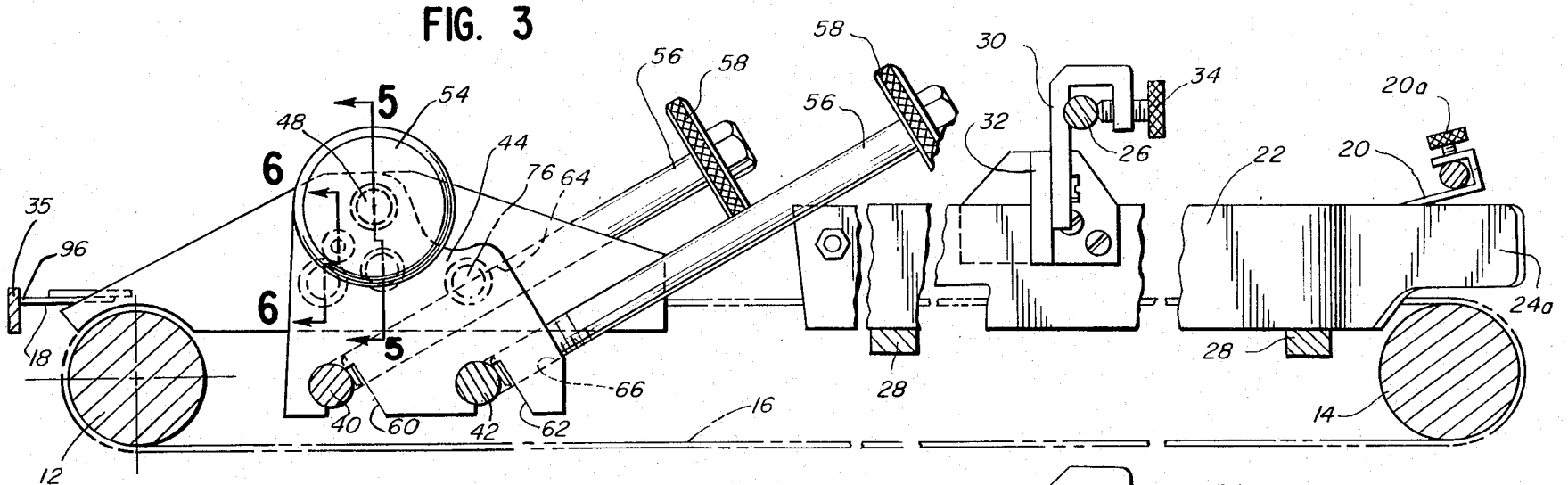
FIG. 3 is a sectional view through the printing machine, showing a fragmented side elevational view of the registering mechanism of the present invention.

More particularly, referring to FIG. 3, each mounting block 44 has a first cutout portion 60 on the underside thereof for embracing rod 40, and a second cutout portion 62 for embracing rod 42. Mounting block 44 is provided with a first threaded bore 64 in line with cutout 60 and directed toward rod 40, and a second threaded bore 66 in line with cutout 62 and directed toward rod 42. Since FIG. 3 is an elevational view looking to the left-side of FIG. 1, it can be seen that stem bolt 56 for the left guide is threaded into bore 66 to condition the left guide as a jogger guide 36 as described above. This is accomplished by tightening stem bolt 56 onto jogger device or rod 42 to clamp the mounting block of the left guide thereto. Rod 42 is reciprocated laterally as is known in the art. It also can be seen that stem bolt 56 for the right guide, stop guide 38, is threaded into bore 64 for tightening against fixed support rod 40 to clamp mounting block 44 of the right guide thereto to condition that guide as a stop guide. Depending upon which guide is the stop guide, the right guide in FIG. 1 and the left guide in FIG. 2, thumb wheel 54 is rotated to rotate control shaft 48 and draw spring loaded blade 46 in abutment against the respective mounting block 44.

Figure 5:
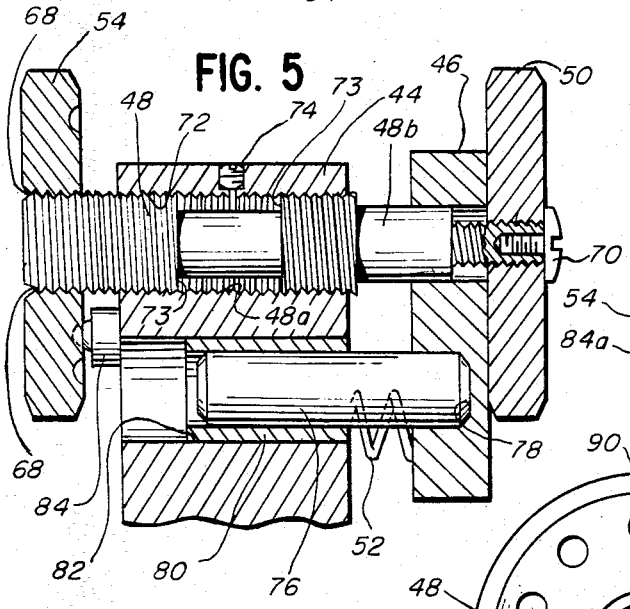
FIG. 5 is a fragmented section taken generally along line 5—5 of FIG. 3.

FIG. 5 shows a sectional view through guide means 36, 38 to illustrate the arrangement and operation of the means for adjusting the spring pressure of spring loaded blade 46 as well as the means for providing floating movement of the blade relative to mounting block 44. More particularly, thumb wheel 54 is shown staked to the outside of control shaft 48, as at 68, to fix the thumb wheel to the outside distal end of the control shaft. Thumb screw 50 actually includes a fastening screw 70 for threaded securement to the inner distal end of control shaft 48 and provide an outer stop limit for spring loaded blade 46. Control shaft 48 is rotatably mounted in a threaded bore 72 in mounting block 44. The control shaft is complementarily threaded except for an intermediate reduced diameter portion **48*a* and an inner reduced diameter, smooth portion 48*b*. Spring loaded blade 46 is slidable on the smooth portion 48*b* of control shaft 48. Reduced diameter portion 48*a* of the control shaft defines opposed shoulders 73 which can abut against a set screw 74 threaded through mounting block 44. The set screw not only provides means for assembling control shaft 48 in mounting block 44, but the set screw is engageable by shoulders 73** to define limits of axial movement of the control shaft.

The means for providing floating movement of spring loaded blade 46 relative to mounting block 44 includes a pilot pin 76 in addition to compression springs 52 which were described above. The inner end of pilot pin 76 is pressed into a blind hole 78 in blade 46, and the outer end of the pilot pin is slidably supported in a bushing 80 press-fit within a bore 82 of mounting block 44. The blade normally is urged away from the mounting block, to the right in FIG. 5, by the pair of compression springs 52 which are disposed on opposite sides of the pilot pin in the direction of movement of sheet 18 through the mechanism. The pilot pin and compression springs are disposed on axes generally parallel to control shaft 48. The positioning of the springs on either side of pilot pin 76 in this manner provides a sensitive spring force to blade 46 such that the blade will respond to the slightest movement of sheet 18 regardless of the point at which it is contacted by the side edge of the sheet.

The tolerance between pilot pin 76 and bushing 80, for supporting and guiding blade 46 in its movement, is designed to provide the blade with a built-in angular floating motion of about 0.010 inch (0.254 mm). The floating motion permits the blade to align itself against the side edge of the sheet to compensate for registration of sheets that are skewed in orientation or out-of-square in cut. Of course, at least a similar tolerance is provided between the blade and the inner reduced diameter, smooth portion **48*b* of control shaft 48**.

Figure 6:
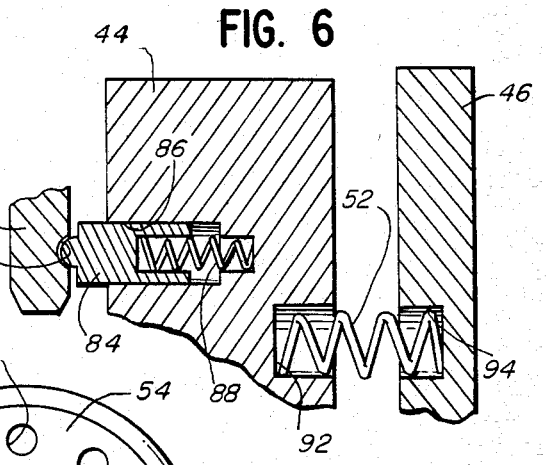
FIG. 6 is a fragmented section taken generally along line 6—6 of FIG. 3.
Figure 7:
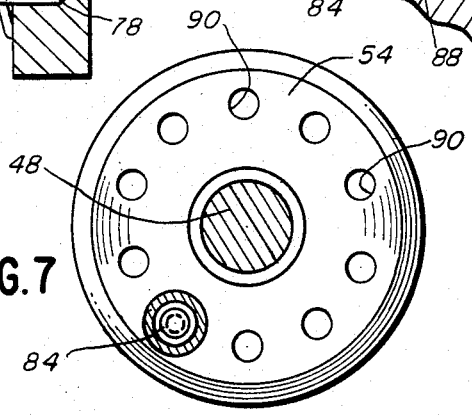
FIG. 7 is a section taken generally along line 7—7 of FIG. 1.

Referring to FIGS. 6 and 7 (as well as FIG. 5), thumb wheel 54 for adjusting the spring pressure on spring loaded blade 46 actually comprises a dial for calibrated adjustment of the spring pressure. More particularly, a detent plunger 84, having a rounded detent head 84*a*, is reciprocally mounted within a bore 86 on the outside of mounting block 44. The detent plunger is spring loaded by a coil spring 88 disposed between the plunger and the base of bore 86. Thumb wheel or dial 54 is provided with a plurality of angularly spaced detent recesses 90 arranged in a circle for engagement by the rounded head of detent plunger 84. Detents 90 coact with detent plunger 84 in mounting block 44 to retain dial 54 at a set position. As viewed from the left in FIG. 5, rotation of the dial in a counterclockwise direction compresses springs 54 and moves blade 46 inwardly toward the mounting block. Conversely, rotation of the dial in the opposite direction relaxes the compression springs and moves the blade outwardly from the mounting block. This fine adjustment of the spring force acting against the blade provides a precise and positive arrangement for accommodating and accurately registering sheets which may be skewed or out-of-square.

Detents 90 also provide a "click" each time the dial is rotated between adjacent detents to give a machine operator an audible and tactile indication as to the amount of adjustment of blade 46, as well as to retain the dial against inadvertent movment from a set position. The abutment shoulders 73 on control shaft 48 limit axial movement of the control shaft and prevents inadvertent dislodgement of detent plunger 84 from block 44. It also can be seen in FIG. 6 that compression springs 52 are disposed at opposite ends thereof within blind holes 92 in mounting block 44 and 94 in blade 46, respectively, to prevent dislodgement thereof. The calibrated dial provided by thumb wheel 44 provides for minute adjustment of blade 46 and may be adjusted while the machine is operating.

Any desired number of detents 90 may be provided depending upon the amount of incremental movement or adjustment desired. For example, detents 90 may be arranged to correspond to the center-to-center spacing of halftone screen dots or other decimal or metric units of measurement. Examples of various calibration spacings of detents 90 for several different halftone screen dots are shown in the Chart below. The examples are based on the use of a control shaft 48 having a threaded body provided with a standard $\frac{3}{8}$–24 thread such that each revolution of the control shaft imparts axial movement thereof on the order of 0.0416 inch (1.04 mm). It is contemplated that the dial be part of a plurality or set of dials which are interchangeable and have calibrations of different increments or units to provide varying incremental movements in response to the control shaft. For interchangeability, staking 68 would be replaced by release means such as fastening screw 70.

ments may be utilized to establish the calibration spacing of detents 90. While the "133 line" screen providing 0.00378 inch (0.096 mm) movement for each "click" might be preferred in the United States using the decimal system, countries using the metric system might prefer the 0.0041 inch (0.104 mm) calibration for each "click", which is the same as the "120 line" screen spacing.

In overall operation, side guides 36, 38 are initially set or positioned to be conditioned as either a spring loaded jogger guide 36 or a stop guide 38. A sheet from the feed tray is advanced and arrested on conveyor board 10 at a position between pre-alignment guide members 22, 24 as shown in FIGS. 1 and 2. The guide members are positioned and locked in place to prealign the sheets to within 0.031 inch (0.79 mm) of the final register position. The sheet then is advanced to a position between guides 36, 38 with a lead end 96 of the sheet in contact with stop finger means 35 for aligning the lead end prior to advancement of the sheet to the gripper means of the impression cylinder, with one side edge of the sheet in contact with blade 46 of stop guide 38 and with the opposite side edge of the sheet spaced approximately 1/32 inch of blade 46 of the spring loaded jogger guide 36. As illustrated by the example above, the calibrated dial or thumb wheel 54 provides for 0.125 inch (3.17 mm) movement of blade 46 to permit precise and final setting for accurately registering the sheets.

On completion of this initial setting of side guides 36, 38, the machine may be started to feed sheets at high speed and final adjustment of the spring loaded blade of jogger guide 36 may be effected during operation of the machine. The jogger guide is secured on jogger rod 42 to provide between 0.015 and 0.75 inch (0.38 mm–1.90 mm) compression of springs 50 by blade 46. The compression of the springs is selectively adjustable by rotating calibrated dial 54 to thereby accommodate registration of sheets of varying types, weights and sizes. The angular float of blade 46 compensates for skewness or out-of-square cut of the sheets within a particular run. At any time during the run, a minute adjustment of one or more dial "clicks" may be made to adjust the spring compression to change the pushing force of blade 46 against the side of a sheet to effect proper action of the blade for either light or heavy weight sheets.

During operation of the machine and registration of the sheets, blade 46 of jogger guide 36 acts against the side edge of the sheet to move the sheet laterally to position the opposite side edge of the sheet in register with blade 46 of stop guide 38. The sheet is held in this position momentarily until a lead end of the sheet is firmly located in appropriate gripper means of an impression cylinder of the machine as is known. At any time during operation, thumb screws 34 may be manipu-

CHART

Calibration For Halftone Screens

| HALFTONE SCREEN | SPACING OF DOTS CENTER-TO-CENTER | ONE HALF DOT SPACING | LINEAR MOVEMENT PER EACH DIAL CLICK | NUMBER OF DETENTS | ANGULAR MOVEMENT PER DIAL CLICK |
|---|---|---|---|---|---|
| 120 line | .008" (.203 mm) | .004" (.102 mm) | .0041" (.104 mm) | 10 | 36° |
| 133 line | .0075" (.190 mm) | .00375" (.095 mm) | .00378" (.096 mm) | 11 | 32.72° |
| 150 line | .007" (.178 mm) | .0035" (.089 mm) | .00347 (.088 mm) | 12 | 30° |

From the foregoing, it can be seen that various size halftone screens or other desired dial "click" movelated to adjust the spacing of pre-alignment guide members 22, 24 and thumb screws 20*a* may be adjusted to vary the pressure of retainer strips 20 on the transported sheets.

After a particular run is completed, and it is desirable to convert a spring loaded or jogger guide 36 to a stop guide 38, or vice versa, as shown alternately in FIGS. 1 and 2, stem bolt 56 can be removed from either bore 64 or bore 66 in mounting block 44 and threaded into the other bore for conversion as described hereinbefore. The above described adjustment and calibration of the respective spring loaded blades 46 then is effected.

Thus, it can be seen that a new and improved sheet registering mechanism has been provided which is simple in construction and operation, and one which can be easily set-up and adjusted without requiring a technician having a high degree of skill in the printing field. The mechanism provides for accurate registration of sheets being fed at high speed, and includes selectively settable dial means for adjusting the spring pressure of the spring loaded blade to accommodate sheets of varying types and weights. The floating movement of the blade accommodates sheets which are skewed in orientation or out-of-square in cut. The dial means is adapted to be interchangeable with similar dials provided with different calibrations such that the incremental units of movement and adjustment of the spring force may correspond to any desired decimal, metric or other units of fine measurements, particularly when dealing with various size halftone screens. Further, the mechanism provides for quick and easy conversion from left hand to right hand jogging, or vice versa, without removing the side guides from the machine or conveyor board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. In a printing machine or the like which includes a sheet conveyor board, a fixed support extending laterally of the conveyor board, and a reciprocating jogger device extending laterally of the conveyor board, a sheet registering mechanism which can be selectively changed to jog sheets from either side of the conveyor board comprising:

a pair of support frames one mounted at each side of the conveyor board and engageable with both said fixed support and said jogger device;

locking means on each support frame and selectively lockable with either the fixed support or the jogger device to form either a stop guide means or a pusher guide means, respectively;

spring loaded movable means on each support frame for acting against a side edge of a sheet; and means on each support frame operatively associated with the respective spring loaded movable means for selectively rendering the spring action thereof inoperative.

2. The mechanism of claim 1 wherein said spring loaded movable means comprises spring loaded blade means and means mounting each spring loaded blade means on its respective support frame for floating movement relative thereto to conform to the side edge of the sheet to accommodate sheets which are skewed in orientation or out-of-square in cut.

3. The mechanism of claim 2 wherein said means mounting the blade means on the support frame includes pilot between the support frame and the blade means, and spring means spaced on opposite sides of the pilot means in the direction of movement of the sheets and disposed between the support frame and the blade means.

4. The mechanism of claim 3 wherein said means mounting the blade means on the support frame further includes means for adjusting the spring pressure of said blade means to accommodate sheets of varying weight.

5. The mechanism of claim 4 wherein said adjusting means comprises a control shaft fixed to the blade means and threaded into the support frame, and manually manipulatable means for rotating the control shaft to adjust the pressure of said spring means.

6. The mechanism of claim 5 wherein said spring means comprises a pair of compression springs disposed on axes generally parallel to the axes of said control shaft and said pilot means.

7. The mechanism of claim 5 wherein said control shaft extends completely through the support frame with the blade means and the manually manipulatable means disposed on opposite sides of the support frame.

8. The mechanism of claim 5, including detent means operatively associated with said manually manipulatable means to provide for calibrated adjustment of the spring pressure.

9. The mechanism of claim 1, including means for adjusting the spring pressure of each said movable means to accommodate sheets of varying weight.

10. A mechanism for registering sheets in a printing machine or the like which includes a conveyor board for delivering the sheets seriatim into contact with a first registration surface in the registering mechanism, comprising:

a support frame mounted on the machine at at least one side of the conveyor board;

spring loaded movable blade means on the support frame for sequentially moving each sheet laterally into engagement with a second registration surface at the opposite side of the conveyor board while maintaining contact with said first registration surface, including pilot means between the support frame and the blade means, and spring means spaced on opposite sides of the pilot means in the direction of movement of the sheets and disposed between the support frame and the blade means whereby the blade means conforms to a side edge of the sheet to accommodate sheets which are skewed in orientation or out-of-square in cut.

11. The mechanism of claim 10 wherein said spring loaded movable means comprises spring loaded blade means for acting against a side edge of the sheet to move the sheet laterally to engage an opposite side edge of the sheet against the second registration surface defined by the stop means.

12. The mechanism of claim 10 wherein said means mounting the blade means on the support frame further includes means for adjusting the spring pressure of said blade means to accommodate sheets of varying weight.

13. The mechanism of claim 12 wherein said adjusting means comprises a control shaft fixed to the blade means and threaded into the support frame and manually manipulatable means for rotating the control shaft to adjust the pressure of said spring means.

14. The mechanism of claim 13 wherein said spring means comprises a pair of compression springs disposed on axes generally parallel to the axes of said control shaft and said pilot means.

15. The mechanism of claim 13 wherein said control shaft extends completely through the support frame with the blade means and the manually manipulatable means disposed on opposite sides of the support frame.

16. The mechanism of claim 13, including detent means operatively associated with said manually manipulatable means to provide for calibrated adjustment of the spring pressure.

* * * * *